US011988047B2

(12) United States Patent
Montuori

(10) Patent No.: US 11,988,047 B2
(45) Date of Patent: May 21, 2024

(54) LOCKING AND ROTATING DEVICE, TWISTER, FOR TUBULAR CASING ELEMENTS FOR VERTICAL EXCAVATIONS

(71) Applicant: SIP & T. S.P.A., Baronissi (IT)

(72) Inventor: Rossella Montuori, Baronissi (IT)

( * ) Notice: Subject to any disclaimer, the term of this patent is extended or adjusted under 35 U.S.C. 154(b) by 57 days.

(21) Appl. No.: 17/628,000

(22) PCT Filed: Nov. 14, 2019

(86) PCT No.: PCT/IT2019/000102
§ 371 (c)(1),
(2) Date: Jan. 18, 2022

(87) PCT Pub. No.: WO2021/014473
PCT Pub. Date: Jan. 28, 2021

(65) Prior Publication Data

US 2022/0268106 A1 Aug. 25, 2022

(30) Foreign Application Priority Data

Jul. 23, 2019 (IT) ..... 202019000002499

(51) Int. Cl.

| | |
|---|---|
| ***E21B 7/20*** | (2006.01) |
| ***E02D 5/38*** | (2006.01) |
| ***E02D 11/00*** | (2006.01) |
| ***E21B 7/26*** | (2006.01) |
| ***E21B 17/02*** | (2006.01) |

(52) U.S. Cl.
CPC ..... *E21B 17/02* (2013.01); *E02D 5/385* (2013.01); *E02D 11/00* (2013.01); *E21B 7/20* (2013.01); *E21B 7/205* (2013.01); *E21B 7/26* (2013.01)

(58) Field of Classification Search
CPC .. E02D 9/00; E02D 9/02; E02D 11/00; E02D 5/385; E21B 17/046; E21B 17/0465; E21B 7/20
USPC ..... 405/243
See application file for complete search history.

(56) References Cited

FOREIGN PATENT DOCUMENTS

| | | |
|---|---|---|
| EP | 2 918 728 A1 | 9/2015 |
| EP | 3 299 572 A1 | 3/2018 |
| ES | 2 293 425 T3 | 3/2008 |

OTHER PUBLICATIONS

ISR; European Patent Office; NL; dated Mar. 31, 2020.
Miriam Spada: "Rotary Drilling Tools", Apr. 3, 2017.

*Primary Examiner* — Robert E Fuller
(74) *Attorney, Agent, or Firm* — Patshegen IP; Moshe Pinchas

(57) ABSTRACT

Locking and rotating device, twister, for tubular casing elements for vertical excavations. Mechanical locking and rotating device also known as twister, consisting of three elements coaxially connected one inside the other (1, 9, 19), by means of plugs and interpenetrating screws in slots formed on the cylindrical surfaces of the elements, in which a first upper element (1) is used to maneuver the device, a second central element (9) used to rotate the lining tube and a third element (19) deputy to the connection of for connecting to the end of the lining tube.

3 Claims, 9 Drawing Sheets

LOCKING AND ROTATING DEVICE, TWISTER, FOR TUBULAR CASING ELEMENTS FOR VERTICAL EXCAVATIONS

FIELD OF INVENTION

Object of the present invention is a mechanical locking and rotating device, also called Twister, for tubular casing elements in particular lining tubes, known as jacket tubes (or molds), for vertical excavations.

BACKGROUND

It is known that in order to drill holes in incoherent soils and in general where there is a risk of collapse of the walls of the hole, it is necessary to use pipes or tubular lining, forming a casing column, with the main purpose of stabilizing the walls of the excavation, and which is inserted into the ground together with the drilling rods, as the drilling progresses. Once the excavation has reached the depth projected, the temporary lining pipes remain in position, allowing the reinforcement cages to be positioned for foundation piles, reinforcements for ties rods, geothermal probes, etc. Once these operations are completed, the temporary lining pipes are recovered. It is known that to facilitate and make safer the work of those who assemble and disassemble the accessories designed to hold the ends of lining pipe together, with the twister or with adjacent pieces of tube, mechanical, hydraulic or pneumatic mechanisms have been developed. These mechanisms replace, in whole or in part, the manual operation by the man, especially when the junction, between the top of the lining pipe, still to be inserted in the ground, and the twister, is made at several meters from the ground. In this case the assembly workers must work in an unsafe manner and the operations are slower.

SUMMARY OF INVENTION

The aim of the present invention is to overcome the aforementioned drawbacks by providing a locking and rotating device (twister), for rotating tubular elements, in particular lining tubes, even very long ones, which securely constrain the lining tube and presents the grip on the lining tube, suitable to allow an optimal transmission of forces, both to carry out the insertion and the extraction of the same, without damaging the conformation of the attachment and of the tube itself with consequent and subsequent difficulties in extracting and damaging it.

Another important aim is to provide a device having a completely mechanical locking and rotating structure and automatic and even manual operation, which is structurally simple.

Finally, the invention aims to obtain a device with a locking and rotating structure that is reliable and safe in the use, capable of increasing the productivity, being less personnel required, and a faster execution, presenting a contained constructions costs.

The aforementioned task and aims, as well as others which will appear more clearly below, are achieved by a locking and rotating device particularly for lining tubes, in vertical excavations consisting of three elements coaxially connected one inside the other, by means of plugs and interpenetrating screws in slots formed on the cylindrical surfaces of the elements, in which a first upper element is used to maneuver the device, a second central element used to rotate the lining tube and a third element for connecting to the end of the lining tube.

Further characteristics and advantages of the invention will become better apparent from the non-limiting description of an embodiment illustrated in the attached drawings

DETAILED DESCRIPTION OF EMBODIMENTS

Figure 1:
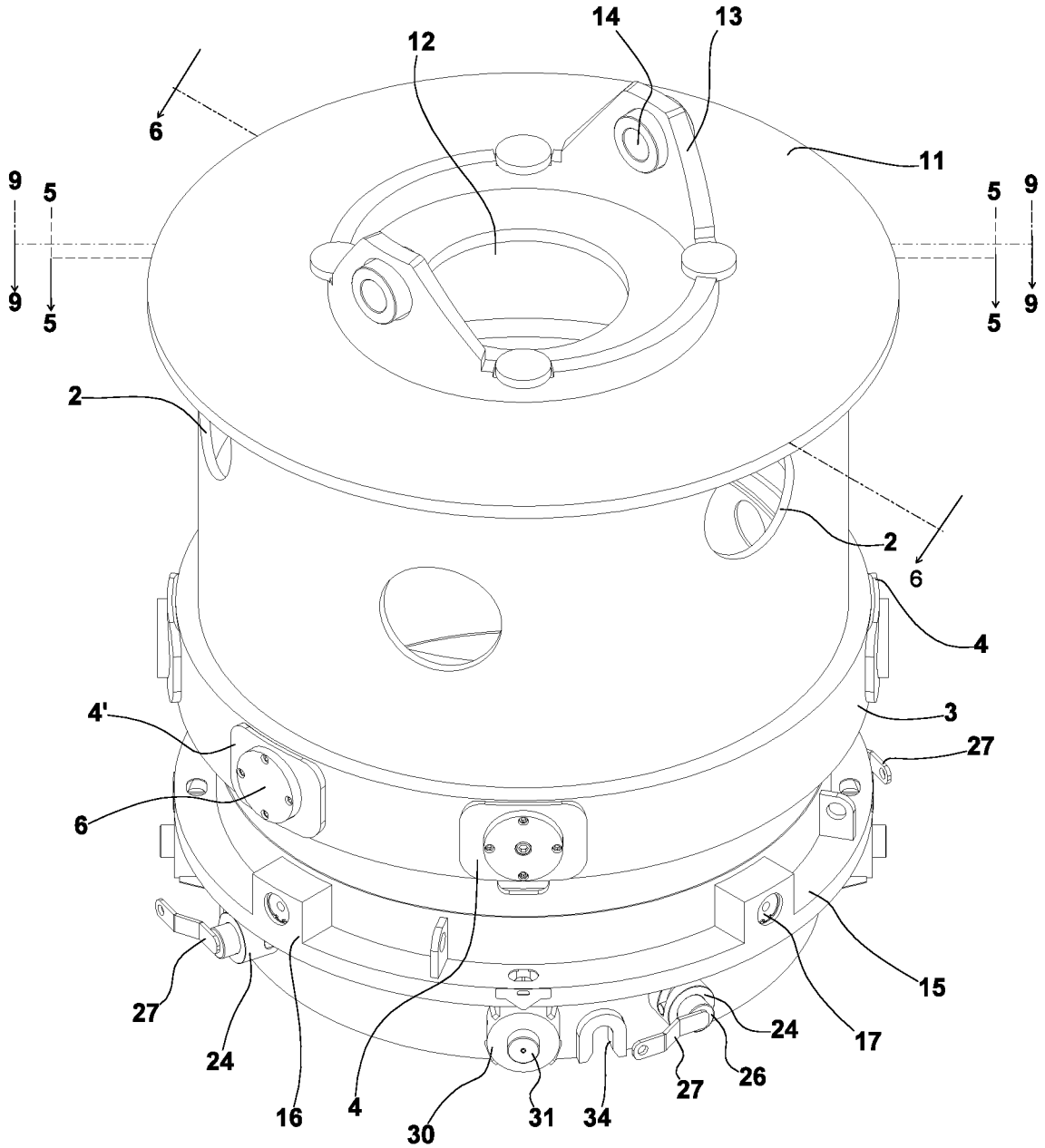
FIG. 1, shows in a perspective view, the device for locking and rotating a tubular element.
Figure 2:
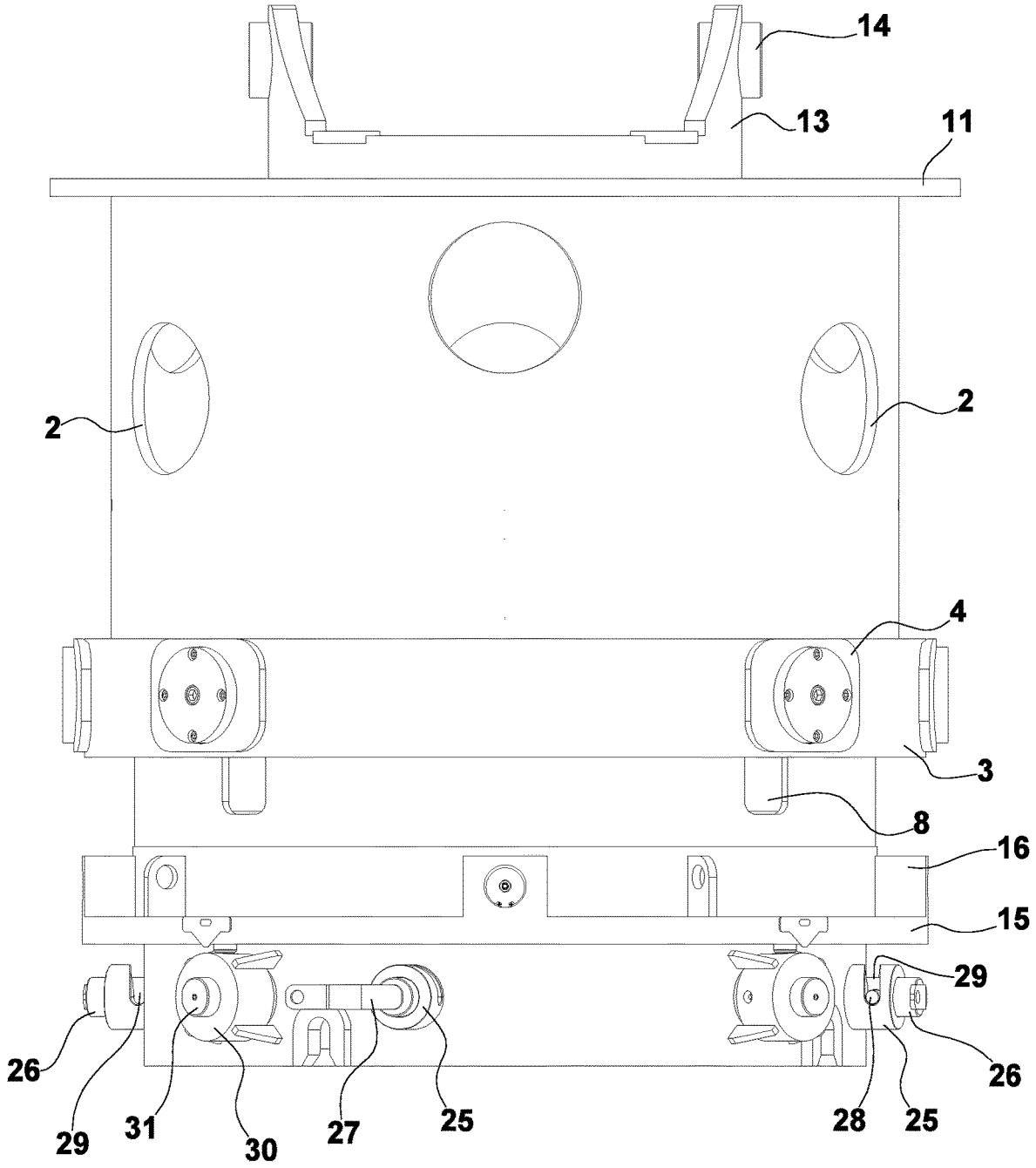
FIG. 2, shows in a side view, the device for locking and rotating a tubular element.
Figure 3:
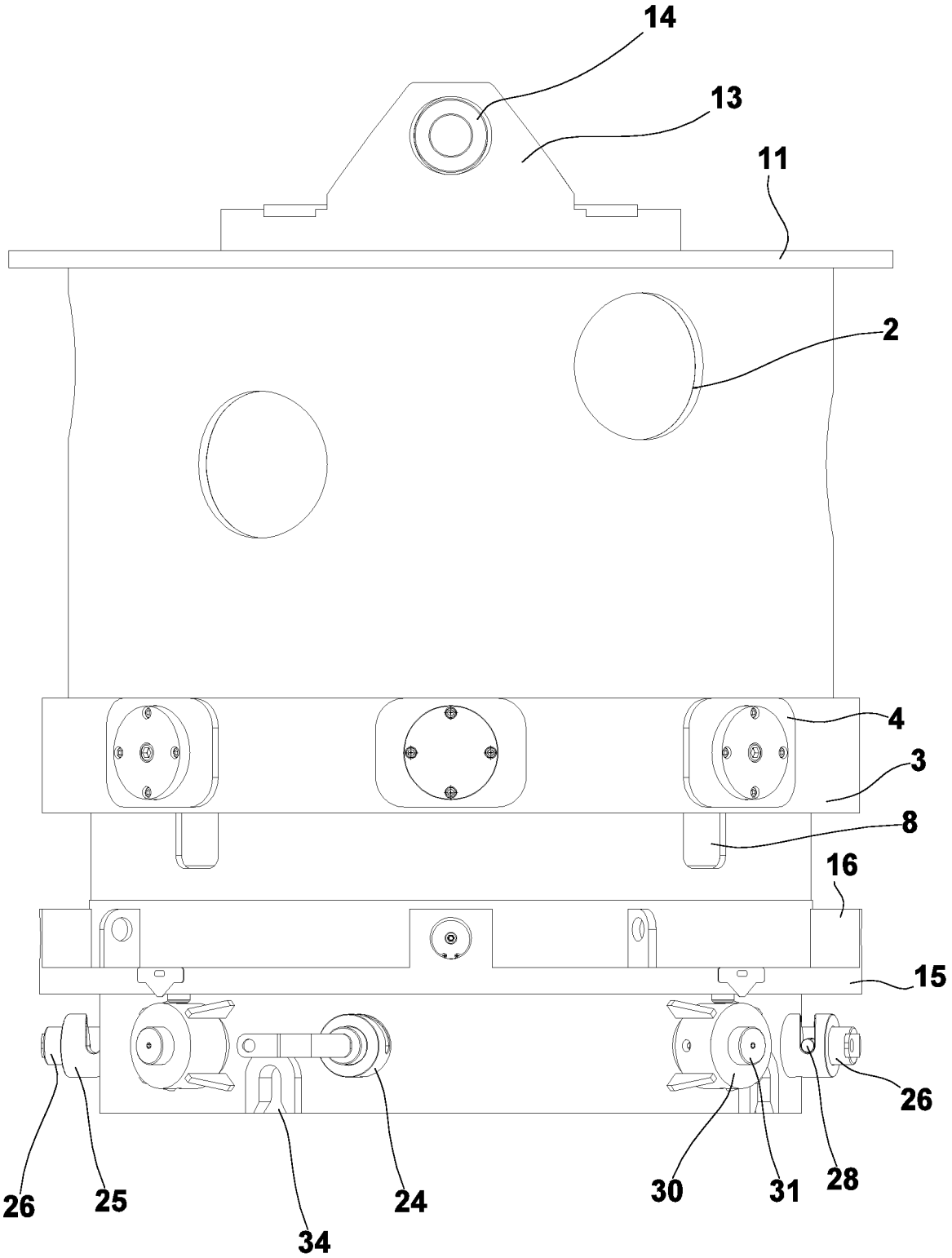
FIG. 3, shows another side view of the device for locking and rotating a tubular element.
Figure 4:
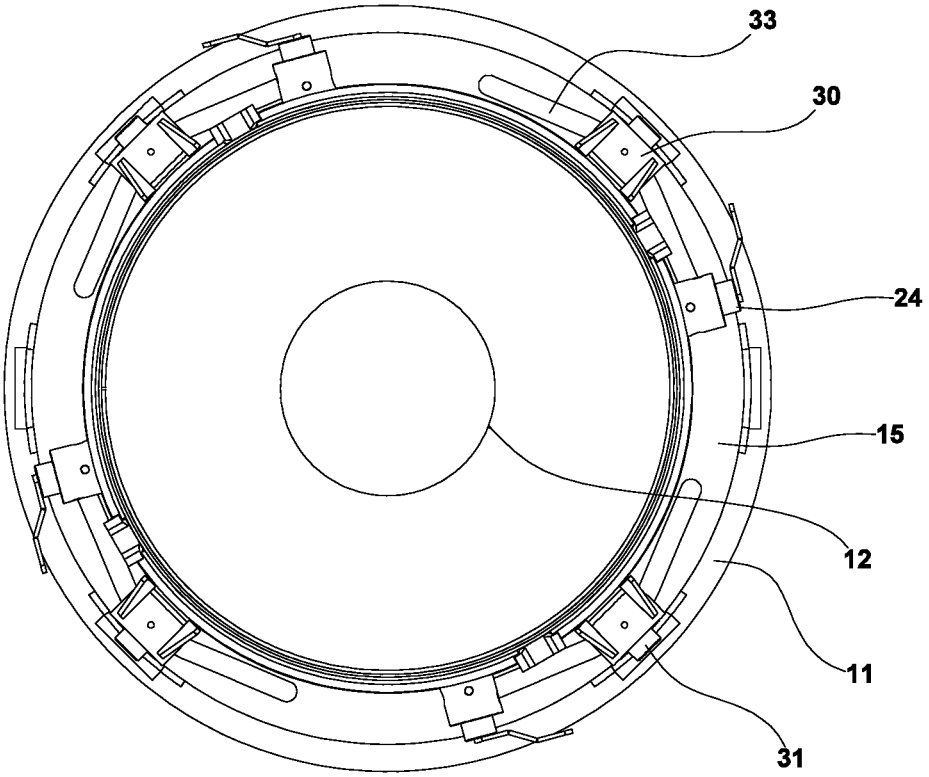
FIG. 4, shows in a plan view from below, the device for locking and rotating a tubular element.
Figure 5:
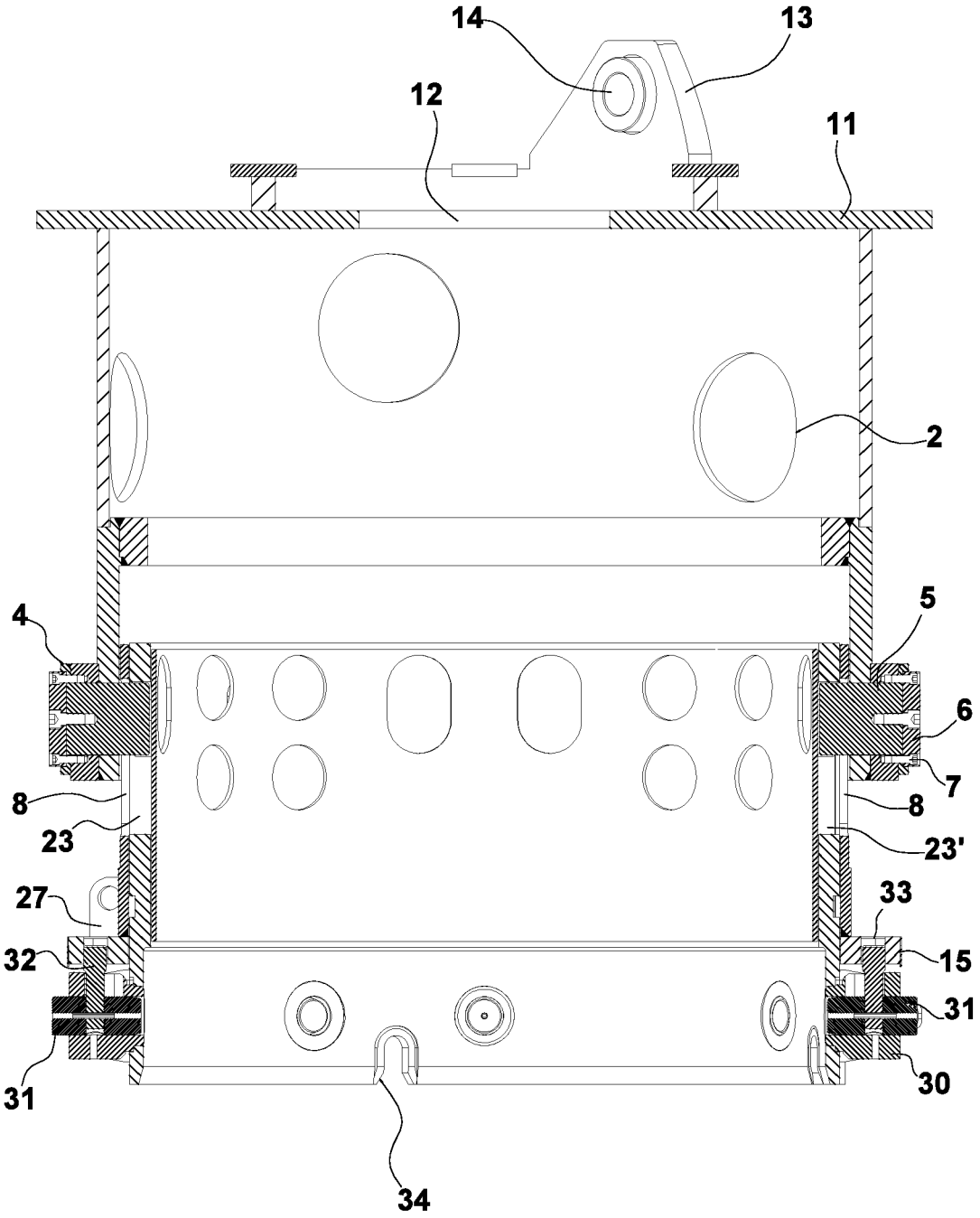
FIG. 5, shows in a section view, the device for locking and rotating a tubular element.
Figure 6:
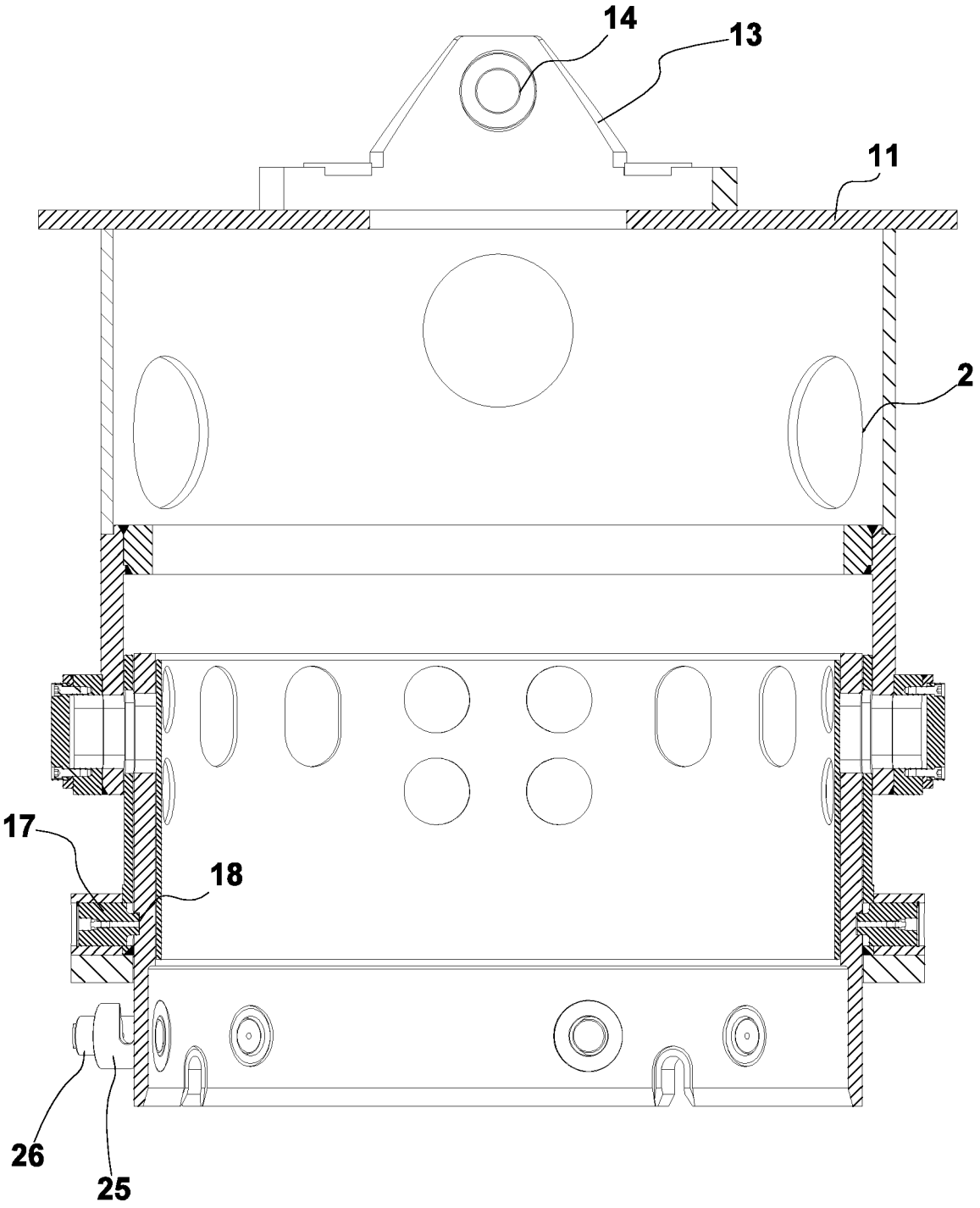
FIG. 6, shows another sectional view of the device for locking and rotating a tubular element.
Figure 7:
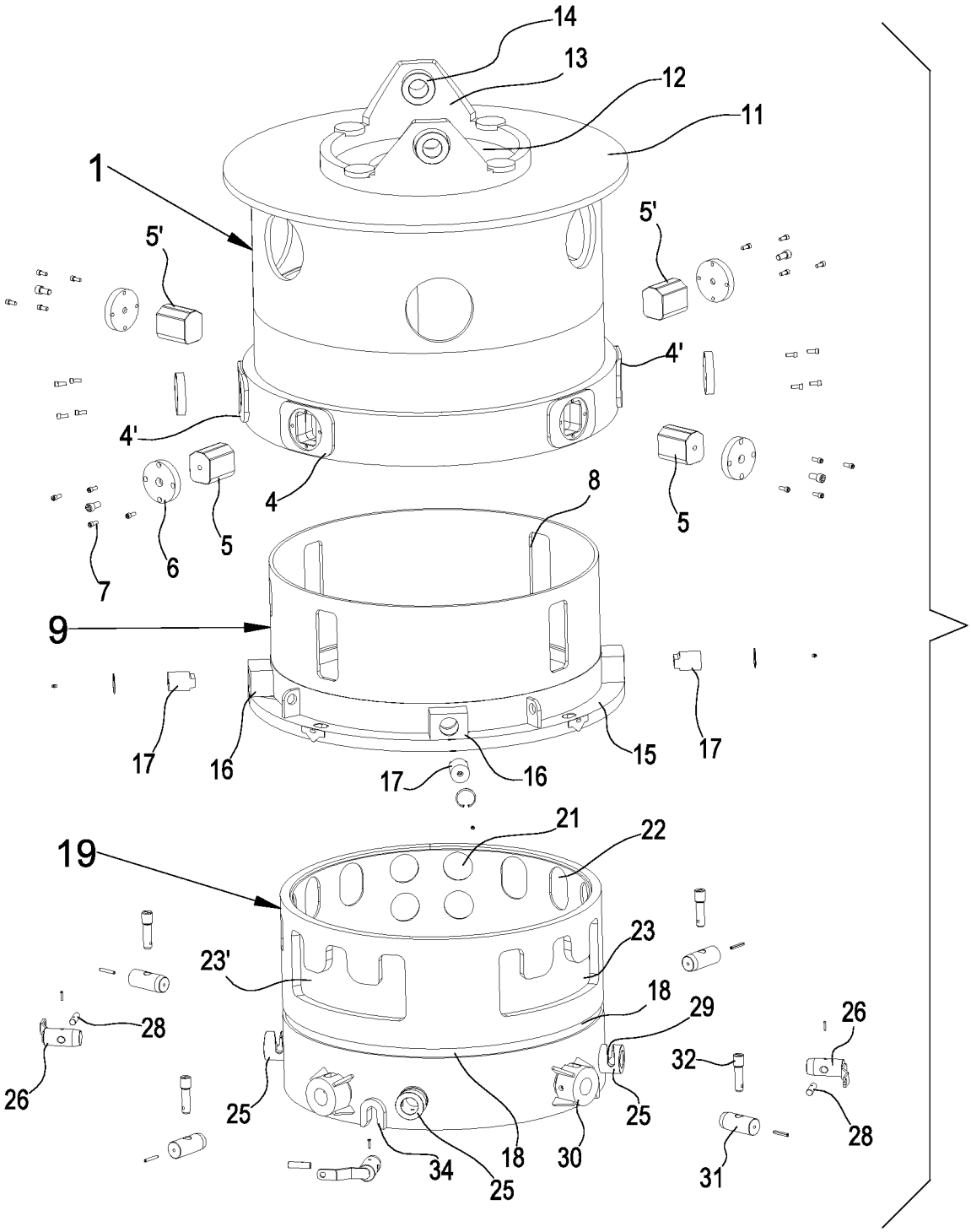
FIG. 7, shows in an exploded view, the various components of the locking and rotating device of a tubular element.
Figure 8:
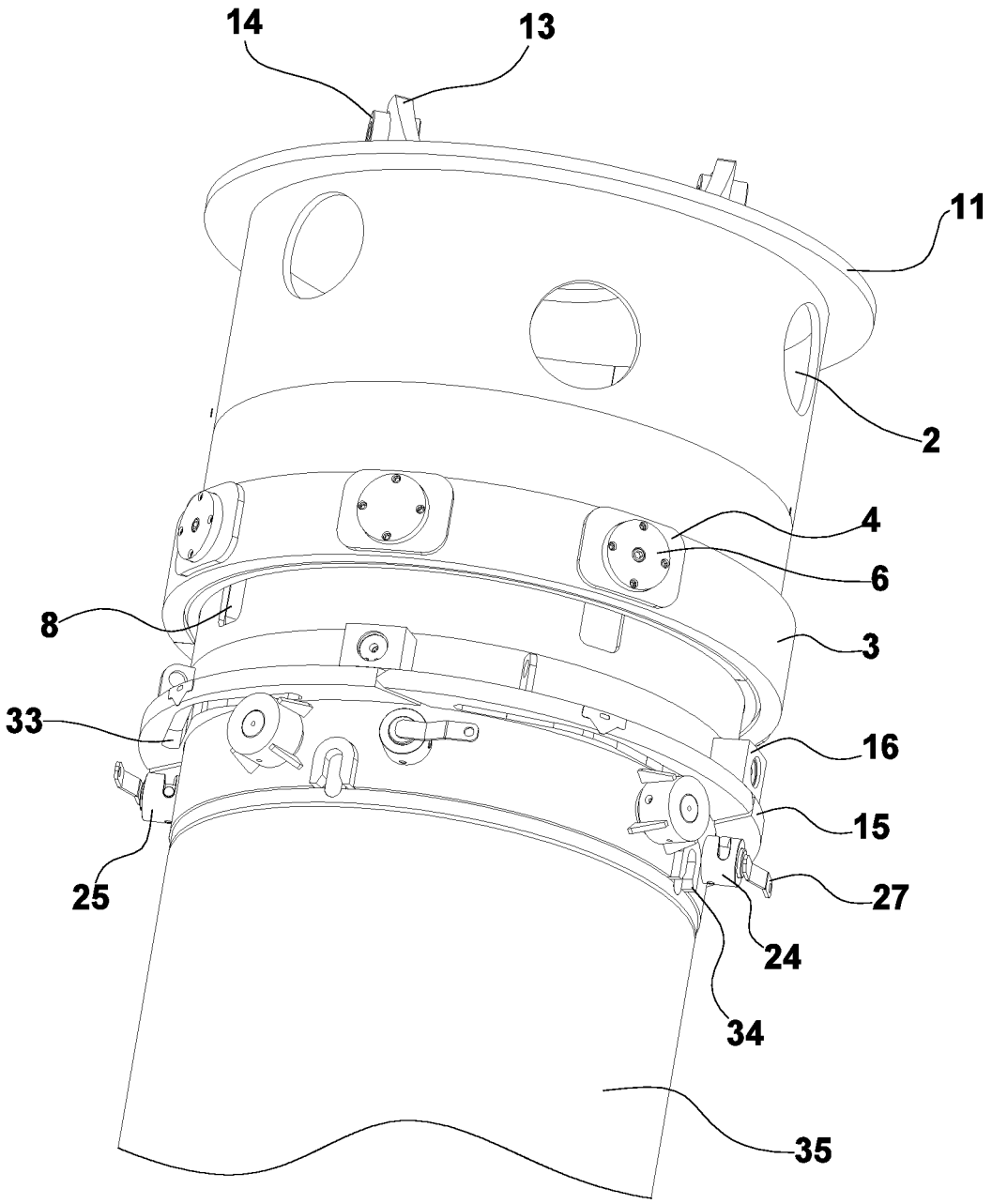
FIG. 8, shows in a perspective view, the locking and rotating device connected to a tubular element.
Figure 9:
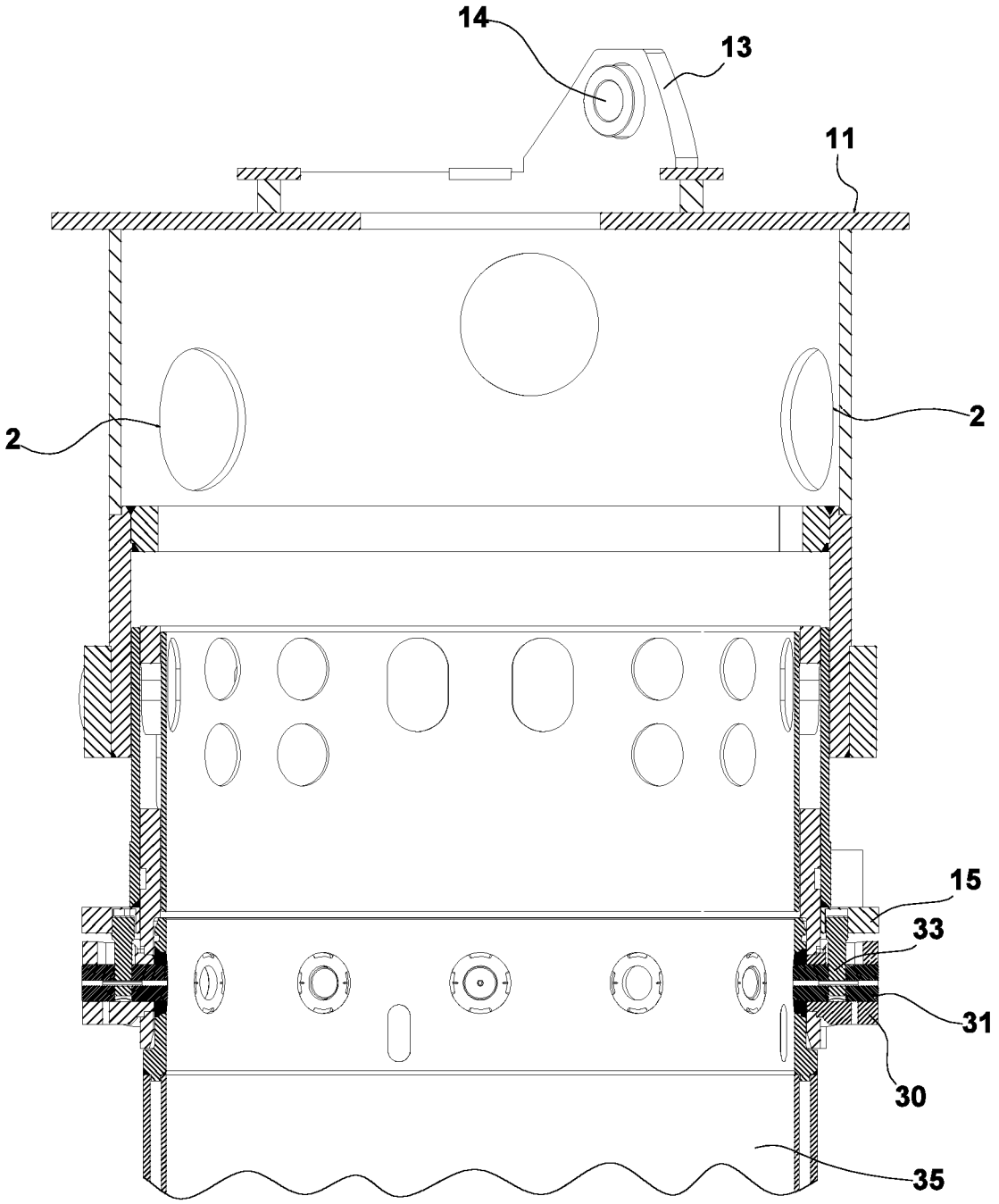
FIG. 9, shows in a section view, the device the locking and rotating device connected to a tubular element.

According to the accompanying drawings, the locking and rotating device, also known as twister, consists of three elements coaxially connected one inside the other, by means of plugs and interpenetrating screws in slots formed on the cylindrical surfaces of the elements themselves, in which a first upper element it is responsible for maneuvering the device, a second central element is essentially devoted to the rotation of the lining tube and a third element is connected to the end of the lining tube, and in which it is indicated with (1) the upper cylindrical element in charge of the operation of the locking and rotating device, the twister, provided on its circumferential surface with circular holes (2) and inferiorly with a collar (3) on which are obtained four seats (4) within which are inserted the pins (5) specially shaped with a polygonal section with rounded corners and a circular head (6). Both the head (6) and the pins (5) are held in place by screws (7). The pins (5) have the function of axial locking, once the end has intercepted one of the rectangular slots (8) of the central cylindrical element (9) placed inside and coaxial with the element (1). The collar (3) is also provided with two other seats (4), identical to the seats (4), and within each of which, in the same way, a pin (5') is inserted, until it intercepts a quadrangular slot (10) of quadrangular opening, of the cylindrical element (9) when placed inside and coaxial with the element (1). These two pins (5') are used as anti-rotation pins in the case of switching from automatic to manual operation of the twister. Above the cylindrical element (1) a plate (11) is welded with a central hole (12) and two appendages (13) with an eye (14), for the attachment and operation of the twister.

The central cylindrical element (9), which acts as a rotary table, has four rectangular slots (8) and two quadrangular slots (10) on its circumferential surface, and below a collar (15), with four seats (16) for pins (17) whose ends intercept the circumferential channel (18), located on the lower cylindrical element (19), when it is inside and coaxial with the cylindrical element (9).

The lower cylindrical element (19) is provided on the lateral circumferential surface with a series of holes of various shaped, circular (21) or elliptical (22), and two slots (23, 23') equal and side by side, each specially shaped with a crenellation that delimit three windows; a groove or circumferential channel (18) which delimits the surface where the connection with the male joint of the lining tube takes place and there are, for this purpose, four holes in which are keyed and subsequently welded the quick-release couplings (24), for the manual operation; they are consisting of a bush (25), a pin (26), an operating handle (27) and a transverse pin (28) which, moving on the eccentric guide (29), makes the pin (26) advance. Furthermore, between the said quick couplings (24), there are, intercalated, the bushes (30) into which the pins with truncated cone section (31) are inserted, each with its pin (32) positioned vertically, whose head fits and slides in the pocket (33) present on the collar (15) of the central cylindrical element (9). The mounting of the device object of the invention it happens like this: the central cylindrical element (9) is keyed coaxially on the lower cylindrical element (19) so that there is a correspondence between the vertical slots (8) and a window of the slots (23, 23'). The truncated-conical section pins (31) which will hook the lining pipe are inserted in the respective bushes (30).

Each of these truncated-conical section pins (31) has a pin (32) positioned vertically with respect to them, and this pin is made to fall inside the pockets (33) present on the collar (15) of the element (9) and thus form a cam-tappet system.

The cylindrical elements (9) and (19) are fixed with the pin (17) that engages in the circumferential channel (18), present on the element (9).

In the last step, the upper cylindrical element (1) is mounted through the guide pins (5) which contextually pass through the vertical slots (8) of the central element (9)

and in the slots (23,23') of the element lower cylindrical (19), thus connecting all the components. Once all the twister components are mounted, the working is as follows: due to gravity, the guide pins (5) are located in the upper part of the slots (23, 23), in particular in the central window of each of them. The vertical pins (32) that act as a tappet in the cam, are located in the central part of the pockets (33) present on the cylindrical element (19).

The twister is hooked through centering keys (34) to the male joint of the lining pipe (35). The borer machine pusches the twister and the guide pins (5) that slide inside the vertical slots (8) and reach the lower part of the slots (23, 23'). The guide pins (5) can move both clockwise and anti-clockwise and drag, through the vertical slot (8), also the cylindrical element (9); under these conditions the cylindrical element (19) is fixed because it is hooked through the centering keys (34) to the lining pipe, while the cylindrical element (9) rotates, dragged by the guide pin. By rotating the central cylindrical element (9) it imparts a rotation which causes the vertical pins (32), which act as a tappet for the cams, to move in the peripheral part of the pockets (33) and push the truncated-conical section pins (31) to the inside of the holes present in the male coupling of the lining tube.

In the case of switching from automatic to manual, the pins (5') will be inserted with the function of anti-rotation plugs. Obviously the pins (5') will be inserted only if, after a failure, it is necessary to switch to manual mode. The seats (4, 4') are covered with a flange equal to the head (6) of the pins (5, 5'). Still in the case of switching from automatic to manual, the handles (27) will be used to operate the pins (26).

The present invention therefore has the following advantages: it allows the assembly of lining tubes, even rather long, under the rotating element in an automatic way, without human intervention, except that of the operator at the controls. It allows to operate also manually in case of breakdowns, malfunctions or other contingencies; it increases safety and productivity by eliminating the dangers and the loss of time of the manual coupling phases, and at the same time presents a simple structure and a lower cost compared to the previous technique. It also offers a continuous and uniform contact surface that is perfectly adherent to the wall of the lining tube with an optimal grip on the pipe, allowing an optimal transmission of forces, both when inserting and extracting it.

The invention claimed is:

1. A locking and rotating device for tubular casing elements the device includes three cylindrical components with a circular section, in a coaxial and nested arrangement, said three cylindrical components include:

a) an upper cylindrical element (1) is provided on its circumferential surface with circular holes (2) and a collar (3) below said circumferential surface, said collar includes four first seats covered by a flange (4) and two second seats (4') and pins (5) each formed with a polygonal cross-section with rounded corners and a circular head (6), said pins and circular head are held in place inside said four seats by screws (7); the collar (3) is provided with two other seats (4') each including an intercepting pin (5'), b) a central cylindrical element (9), including four rectangular slots (8) and two quadrangular slots (10) defined on its circumferential surface, and a collar (15) defining four seats (16) for holding pins (17) and pockets (33) wherein the two quadrangular slots (10) are configured to be engaged by the intercepting pin (5'), when the central cylindrical element (9) is placed inside and coaxial with the upper cylindrical element (1);

c) a lower cylindrical element (19) including a lateral circumferential surface provided with a series of holes, and two slots (23, 23') equal and side by side, each shaped with a crenellation, to form an area limiting the movement of the pins (5); said lower cylindrical element (19) further includes a circumferential channel (18) and a coupling surface configured for connection with a male joint of a lining tube (35), said coupling surface includes four holes including quick-release couplings (24) having a bush (25), pin (26), operating handle (27) and transverse pin (28) able to move on an eccentric guide (29); said coupling surface further includes bushes (30) configured to hold truncated-conical section pins (31), each one of the truncated-conical section pins includes a vertical pin (32) configured to be inserted and to slide into one of the pockets (33) defined on the collar (15) of the central cylindrical element (9);

wherein the ends of pins (17) intercept and fit into the circumferential channel (18) when the lower cylindrical element (19) is inside and coaxial with the cylindrical element (9).

2. The locking and rotating device for tubular casing elements as in claim 1, the central cylindrical element (9) is keyed coaxially on the lower cylindrical element (19) by said pins (5) to realize a correspondence between the vertical slots (8) and a slot of windows (23, 23'); each of the truncated-conical section pins (31) is inserted in the respective bushes (30) and has the pin (32) positioned vertically with respect to it, which falls inside the pockets (33) and form a cam-tappet system; the upper cylindrical element (1) is connected through the guide pins (5) which simultaneously pass through the vertical slots (8) of the central element (9) and in the slots (23, 23') of the lower cylindrical element (19).

3. The locking and rotating device for tubular casing elements as claimed in claim 1, wherein:

in an initial position, the guide pins (5) are located in an upper part of the slots (23, 23') and the vertical pins (32) are located in a central part of the pockets (33) of the cylindrical element (19);

the guide pins (5) are configured to slide inside the vertical slots (8) and reach a second position in a lower part of the slots (23, 23') due to downward thrust;

in the second position the guide pins (5) are configured to move both clockwise and anticlockwise to thereby rotate the central cylindrical element (9) via the vertical slot (8); and rotation of the central cylindrical element (9) causes the vertical pins (32) to move from the central part of the pockets (33) to a peripheral part of the pockets (33) and push the pins (31) into holes present on the male joint of the lining tube.

* * * * *